United States Patent [19]

Hurst et al.

[11] 4,008,739

[45] Feb. 22, 1977

[54] DROP CENTER TANK

[75] Inventors: Doug Hurst, Montreal West, Canada; Erling Mowatt-Larssen, Warren, Ohio

[73] Assignee: General American Transportation Corporation, Chicago, Ill.

[22] Filed: Feb. 24, 1975

[21] Appl. No.: 552,651

[52] U.S. Cl. ..... 141/35; 137/575; 141/98

[51] Int. Cl.[2] ..... B65B 31/00; F17D 1/00

[58] Field of Search ..... 141/1, 2, 35, 36, 67, 141/98, 113, 231–233; 137/1, 575; 105/358, 360

[56] References Cited

UNITED STATES PATENTS

| | | | |
|---|---|---|---|
| 2,979,087 | 4/1961 | Vogt | 141/113 |
| 3,675,670 | 7/1972 | Ogawa | 137/1 |
| 3,687,087 | 8/1972 | Yurkoski et al. | 105/358 X |
| 3,722,556 | 3/1973 | Jeffers et al. | 141/2 |

*Primary Examiner*—Richard E. Aegerter
*Assistant Examiner*—Frederick R. Schmidt
*Attorney, Agent, or Firm*—Prangley, Dithmar, Vogel, Sandler & Stotland

[57] ABSTRACT

A railway train includes a plurality of interconnected tank cars, each car comprising a tank provided with two lading conduits in the top thereof extending thereinto for communication with the interior thereof and each having an outer end extending above the tank and toward the adjacent end thereof and terminating inboard of the adjacent tank car end, the lading conduits of adjacent cars being interconnected by flexible connecting conduits; one lading conduit extends diagonally downwardly and terminates near the bottom of the tank for filling and/or eduction unloading thereof with the other lading conduit terminating near the top of the tank for venting and filling of an adjacent tank and for automatically determining the outage of the tank. An inlet and outlet assembly may be mounted in the bottom of the tank providing a sump in registry with the bottom terminal portion of the eduction conduit.

11 Claims, 4 Drawing Figures

DROP CENTER TANK

CROSS REFERENCE TO RELATED APPLICATION

This application is an improvement of our copending application, Ser. No. 403,828, filed Oct. 5, 1973, and entitled MANIFOLDED TANK CARS FOR UNIT TRAIN SERVICE, now U.S. Pat. No. 3,897,807, the disclosure of which is incorporated herein by reference.

BACKGROUND OF THE INVENTION

The present invention relates to railway tank cars and, in particular, to manifolded tank cars which may be interconnected to accommodate loading or unloading of the entire group of interconnected cars without movement thereof from a single point therealong, thereby acccommodating consecutive loading, transporting and unloading of fluid ladings and facilitating the formation of unit trains.

The concept of providing fluid communication among a series of interconnected railway tank cars is disclosed in the prior art but previous systems have failed to provide an intertank connection arrangement which insured safe handling of the fluid ladings during transportation. For example, U.S Pat. No. 1,542,116, issued to R. Welcker, discloses railway tank cars for interconnection in a manifolded arrangement to accommodate continuous emptying of the interconnected tanks from a single location, without moving or disconnecting the cars. However, Welcker's arrangement does not provide for continuous loading of the interconnected tanks from a single location, and the intertank lading connections are along the longitudinal axes of the tanks which has been found to be a disadvantageous arrangement.

U.S. Pat. No. 3,722,556, issued to William Jeffers et al., discloses a manifolded tank car arrangement which accommodates both loading and unloading of a string of interconnected tank cars from a single location, but Jeffers et al. provide the intertank lading connections at the bottoms of the tanks. Further, Jeffers et al. do not provide a lading conduit which during loading automatically determines the final outage of the lading in the tank, a feature which is critically necessary with certain bulk lading commodities to accommodate product expansion in transit.

U.S. Pat. No. 3,675,670 issued to Osamu Ogawa, discloses interconnected tank cars which require external piping for drainage and externally mounted valves. These features are disadvantageous for in the first case added material cost is involved while in the second case a hazardous situation could arise in case of a train wreck.

SUMMARY OF THE INVENTION

The present invention relates to a railway tank car for unit train service which permits a train of such cars to be loaded or unloaded without movement thereof from a single location, and accommodates consecutive loading, transportation and unloading of liquid ladings all in safety and with improved economy of time and manpower.

It is an important object of the present invention to provide a tank car for a railway tank car train for interconnection in fluid communication with associated like tank cars by flexible connecting conduits for accommodating consecutive loading, transporting and unloading of expandable liquid loadings, the tank car comprising a wheeled chassis structure provided with chassis coupling means for coupling to the chassis of associated like cars, a tank mounted on the chassis structure, a lading vent conduit and a lading eduction conduit respectively coupled to the tank adjacent to the opposite ends thereof and being in fluid communication therewith, each of the lading conduits extending through the top of the tank and having an outer end extending outwardly from the tank adjacent to the top thereof and terminating inboard of the associated tank car end, the inner end of the vent conduit terminating a predetermined distance below the top of the tank, filling of the tank to a level above the inner end of the vent conduit causing compression of gas trapped above the liquid lading to a pressure at which occurs outflow of liquid lading through the vent conduit at the same rate as the inflow of liquid lading through the eduction conduit thereby to provide in the tank above the liquid lading a free vapor space, the eduction conduit extending diagonally downwardly in the tank and terminating closely adjacent to the bottom of the tank to facilitate emptying of the tank through the eduction conduit, and conduit coupling means on each of the lading conduits for coupling to an adjacent end of an associated flexible connecting conduit to place the tank in fluid communication with the tanks of adjacent-like tank cars, whereby the tank may be connected by associated flexible connecting conduits to associated-like tanks in a series through which expandable liquid lading may flow to accommodate consecutive loading to a predetermined level, transporting thereof while automatically providing a free vapor space at the top of the tank above the liquid lading, and substantially complete unloading thereof through the eduction conduit.

It is another object of this invention to provide a railway tank car of the type set forth, wherein the inner end of the lading conduit serving as the input conduit during loading extends diagonally downwardly and terminates closely adjacent to the bottom of the tank to facilitate eduction unloading of the tank through said conduit.

It is a further object of this invention to provide a railway tank car of the type set forth, wherein valves are mounted on the tanks and are connected to the lading conduits to isolate the lading in each tank car during transit.

These and other objects of the present invention together with further objects and advantages thereof will best be understood by reference to the following specification taken in connection with the accompanying drawings:

DESCRIPTION OF THE PREFERRED EMBODIMENT

Figure 1:
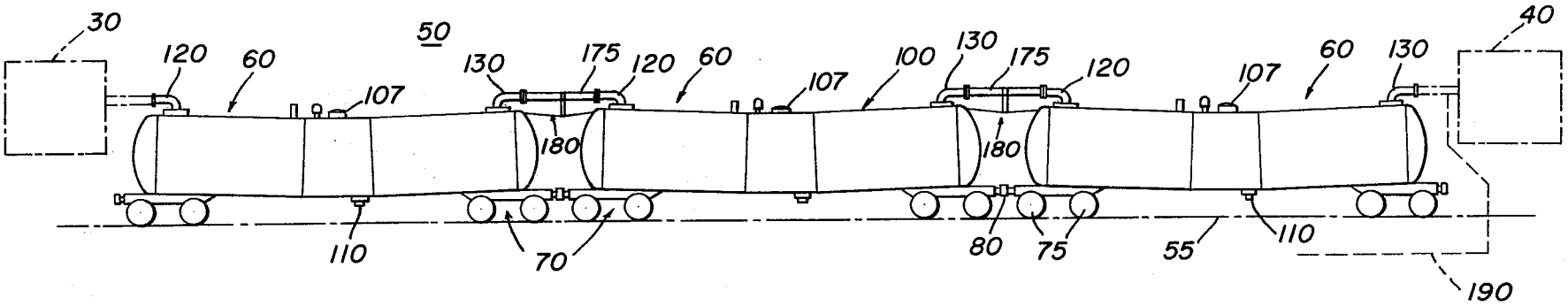
FIG. 1 is a side elevational view of railway tank cars of the present invention arranged in train configuration.

Referring now to FIGS. 1 through 4 of the drawings, there is illustrated a railway train, generally designated by the numeral 50, comprising three railway tank cars 60. Each of the tank cars 60 includes a pair of trucks 70 respectively disposed at the opposite ends thereof and each provided with pairs of rail wheels 75 for rolling engagement with the rails of a standard railway track 55. Each tank car 60 is further provided with a coupler 80 at each end thereof for coupling adjacent tank cars together in tandem relationship. Mounted on each of the truck assemblies 70 is a longitudinally extending center sill 90 and an arcuate saddle bolster 95 for supporting thereon one end of an associated tank 100.

The tank 100 includes a generally cylindrical side wall 103 with the longitudinal axis thereof disposed in use substantially horizontally and having the opposite ends thereof respectively closed by generally dome-shaped tank heads 105 for defining a completely enclosed liquid lading compartment. Formed in the top of the cylindrical side wall 103 substantially midway between the ends thereof is a cylindrical manway 107 extending substantially vertically upwardly from the tank side wall 103 and closed at the upper end thereof by a manway cover 109. Connected to the bottom of the tank side wall 103 generally midway between the ends thereof is a loading and unloading assembly, generally designed by the numeral 110, and including a fitting 111 mounted as by welds 112 over a complementary opening 113 in the bottom of the wall 103 of the tank 100. An opening 114 at the bottom of the fitting 111 is in registry with a short loading, unloading pipe 117 which is provided with a cover 118. The fitting 111 forms a sump 135 with the bottom of the wall 103, the bottom of the sump being below the bottom of the tank 100. The bottoms of the walls 103 respectively slope downwardly from both ends of the tank 100 to the sump 135 and the assembly 110 to facilitate draining of the lading, as will be set forth.

The tank 100 has a vent conduit 120 disposed adjacent to the end 105 of the tank 100. The vent conduit 120 includes an adaptor fitting 121 having a reduced diameter lower portion 122 received in a complementary opening or port in the top of the tank side wall 103 adjacent to the end 105 thereof, and a valve 123 extending through the tank side wall 103 in surrounding and sealing relationship with the associated port. The valve 123 has a butterfly disc (not shown) therein, the valve being coupled by suitable bolts (not shown) to an elbow 125, which in turn is connected to a horizontally extending conduit section 127 disposed substantially parallel to the longitudinal axis of the tank 100. A protective valve housing 128 surrounds the valve 123 and elbow 125. The outer end of the horizontal section 127 extends outwardly adjacent to the top of the tank 100 and terminates inboard of the end 105 in an annular attachment flange 129. Reference should be made to our above-identified patent application for further description of the valve 123 and the housing 128 therefor.

The tank 100 is also provided with an eduction conduit 130 which includes a fitting 131 sealingly positioned in registry with an opening 132 in the top of the tank wall 103. A short curved pipe section 133 extends downwardly from the fitting 131 and is sealingly connected to a diagonally downwardly extending straight pipe section 134. The straight pipe section 134 extends diagonally downwardly about halfway through the tank 100 and terminates in a flange 136. A second straight pipe section 138 has a flange 139 at the upper end thereof which is sealingly connected to the flange 136 by means of a plurality of bolts 140. The pipe 138 extends diagonally downwardly to a short curved pipe 143 which in turn is connected to a short straight section 144 which is disposed substantially normal to the sump 135 formed by the fitting 111 and substantially normal to the longitudinal axis of the tank 100. The straight pipe section 144 is maintained in place by a spyder 150 which is provided with an annular collar 151 and outwardly extending webs 152. The webs 152 are secured to an annular sealing plate 155 connected to the bottom of the tank wall 103 as by welds 156.

A support 165 includes a bar 166 pivotally connected at one end thereof to an attachment flange 167 mounted at the top of the tank wall 103 and pivotally connected at the other end thereof to an attachment flange 168 fixedly connected to the pipe 138, thereby to support the diagonally extending eduction conduit 130 from the top of the tank 100.

The eduction conduit 130 has connected thereto a valve 160 (with a butterfly disc therein, not shown) sealingly connected to the top of the tank wall 103 in registry with the opening 132. A short curved pipe section 161 extends outwardly and above the tank 100 and is connected to a short straight pipe section 162 disposed substantially parallel to the longitudinal axis of the tank 100. The outer end of the pipe 162 terminates in an annular attachment flange 164 inboard of the associated tank end 105. A protective valve housing 148 is also provided for the valve 160, as previously described. Operation of the valves 121 and 160, and more particularly the butterfly discs (not shown) is set forth in our above-identified copending patent application.

The attachment flanges 129 and 164 of the vent conduit 120 and the eduction conduit 130, respectively, are constructed and arranged complementary to corresponding flanges 170 at the opposite ends of a flexible connecting conduit 175, whereby each of the flanges 129 and 164 may be connected, as by nuts and bolts (not shown) to the corresponding flange 170 of the flexible conduit 175 for providing a flexible coupling between the vent conduits 120 and eduction conduits 130 of adjacent tank cars 60. In this manner, a unit train 50 may be formed with the tanks 100 and the vent conduits 120 and eduction conduits 130 of the interconnected manifolded cars 60 cooperating with the flexible connecting conduits 175 to form a continuous lading vessel extending the entire length of the train 50. The flexible conduits 175 are of such a length as to accommodate the normal maneuvers of a railway train 50 without danger of rupturing the connection formed by the flexible conduits 175.

The flexible conduits 175 are supported by a catenary support 180 as disclosed in our above-referenced copending patent application which serves to support the flexible conduits 175 and to maintain them in position level with or above the associated vent and eduction conduits 120 and 130, respectively, to facilitate draining and emptying of the liquid lading.

In operation, a plurality of tank cars 60 are coupled together as illustrated in FIG. 1 with the adjacent input-output conduits 120 and 130, respectively, of adjoining cars 60 coupled together by flexible interconnecting conduits 175 in the manner described above. While three of such interconnected railway cars 60 have been illustrated in FIG. 1, it will, of course, be appreciated that the railway train 50 may comprise any desirable number of such railway tank cars 60. When it is desired to fill the tanks 100 of the train 50 with fluid lading, the input end of the train 50 is moved into position adjacent to an associated source 40 of liquid lading, which is connected to the eduction conduit 130 at the adjacent end of the train. The vent conduit 120 at the other end of the train may be vented to the atmosphere or may be coupled to a scrubber 30 or other suitable anti-pollution device. Valves 123 and 160 associated with each of the conduits 120 and 130 are opened to establish connection between each of the individual tank cars 60 of the train 50.

The fluid lading, which is normally a liquid lading, is introduced into the first tank 100 at the right end of the train 50, as illustrated in FIG. 1. When the tank 100 is filled to a predetermined level, the pressure of the vapor therein above the liquid lading will build up and push the liquid lading upwardly through the vent conduit 120 at the other end of the tank 100 and thence through the flexible connecting conduit 175 and into the next adjacent tank 100 through the eduction conduit 130 thereof. When that next tank 100 is filled to a predetermined level, the liquid lading will flow therefrom to the next succeeding tank and this process will continue until all of the tanks 100 in the train 50 have been filled to the predetermined level with the liquid lading. It will be noted that the entire train 50 of tank cars 60 can be filled from a single location without moving any of the tank cars 60 or disconnecting them from one another.

It is a significant feature of the present invention that the level to which the tank 100 will be filled with liquid lading is predetermined by the distance which the inner end 122 of the vent conduit 120 extends below the top of the tank shell 103. This level is preferably set so that there will be provided a free vapor space or "outage" above the liquid lading at the top of the tank 100, which vapor space is required in the case of expandable liquid ladings, including flammable liquid ladings. It will be appreciated that when the level of the surface of the liquid lading within the tank 100 reaches the bottom of the vent pipe 122, it will close the opening therein and prevent further escape of vapors therethrough, after which the remaining vapors at the top of the tank 100 will be compressed as filling of the tank 100 continues. The pressure build-up will continue until it is sufficient to force liquid lading through the vent pipe 122 to the next adjacent tank 100. It will, therefore, be understood that by judiciously selecting the length of the vent pipe 122, the maximum level of liquid lading within the tank and, therefore, the minimum volume of freeboard or outage at the top of the tank will be determined.

After the train 50 of tank cars 60, and specifically the tanks 100 thereof, have been loaded, it is desirable prior to transport of the train 50 to empty all lading from the flexible connecting conduits 175 between adjacent tanks 100 and also from the other conduits 120 and 130. It will be appreciated that this is desirable so that there will be no lading in the conduits outside of the tanks 100, during transport of the train 50, all for safety reasons. If the lading is flammable or otherwise dangerous, it is desirable to have no lading in these conduits in the event of an accidental rupture of any of the conduits or an accidental separation of the cars 50 and the associated tanks 100 during transport.

In order to remove from the conduits 120, 130 and 175 all liquid lading at the end of a loading operation, in accordance with a first preferred method, a source of high pressure gas is connected to the input end of the train of tank cars, and specifically to the eduction conduit 130 that was connected to the source 40 of liquid lading. The gas pressure will force the liquid lading from the right-handmost conduit 130 and in so doing will push a corresponding quantity of lading upwardly through the vent conduit 120 in the right-handmost car and through the flexible connection 175 and into the adjacent car, the middle car as illustrated in FIG. 1. As soon as the level of liquid in the right-handmost car falls below the lower end of its vent conduit 120, the air under pressure will force all of the liquid upwardly and out of the vent conduit 120, the associated flexible conduit 175 and that portion of the connection eduction conduit 130 above the liquid level in the adjacent middle tank car. This process will be repeated down the entire string of tank cars 60 until the conduit 120 and the flexible conduit 175 and the portion of the eduction conduit 130 above liquid level in the left-handmost car have been emptied, thus to empty all of the conduits 120, 130 and 175 throughout the entire length of the train 50 in seriatim. It will be appreciated that the liquid level in the last tank car loaded prior to the emptying of the conduits must be such that the last tank car loaded can accept all of the lading from the conduits along the entire length of the train 50.

In a second preferred method of emptying the conduits 120, 130 and 175 along a train of tank cars 60, the eduction conduit 130 that was connected to the supply 40 of liquid lading is closed and the vent conduit 120 that was connected to the scrubber 30 is connected to a source of subatmospheric pressure or vacuum. As a result, there will be a pressure differential between the right-handmost eduction conduit 130 in FIG. 1 and the left-handmost vent conduit 120 just as was the case in the first preferred method described above. As a consequence, there will be a seriatum emptying of the conduits 120, 130 and 175 progressively from the right in FIG. 1, through to the left-hand end of the train 50 in FIG. 1. After the pressure in the tanks has fallen to atmospheric pressure, the eduction conduit 130 that was connected to the supply 40 of liquid lading will be vented to atmosphere. It will be seen that in this method also, the level of liquid lading in the left-handmost car, i.e., the car last loaded, must be low enough so that car can accept all of the lading from the conduits 120, 130 and 175. After all the lading is out of the conduits 175, the valves 121 and 160 are closed to provide a plurality of sealed containers.

It is a significant feature of the present invention that the conduits 120 and 130 and the flexible connecting conduit 175 are so constructed and arranged as to accommodate all of the various types of movement which a train normally undergoes in transit thereby to facilitate a safe and unencumbered transportation of the train 50 of tank cars 60.

More particularly, in the preferred embodiment of the invention the outer ends of the conduits 120 and 130 are respectively set back behind the domed heads 105 of the tank, i.e., each of these conduits terminate inboard at points between the associated protective housings 128 and 148 and the head 105 at the adjacent end of the tank 100. This set-back position of the ends of the conduits 120 and 130 permits the flexible connecting conduit 175 to be of a length sufficient to provide a considerable amount of slack between adjacent tanks 100 when the tanks are on a straight portion of track 55. This slack length in the connecting conduit 175 insures that there will be no undue stresses placed on the flexible conduit 175 or the conduits 120 and 130 as the train undergoes various track conditions such as sharp curves, inclines, banked curves, uneven rails and the like.

Figure 2:
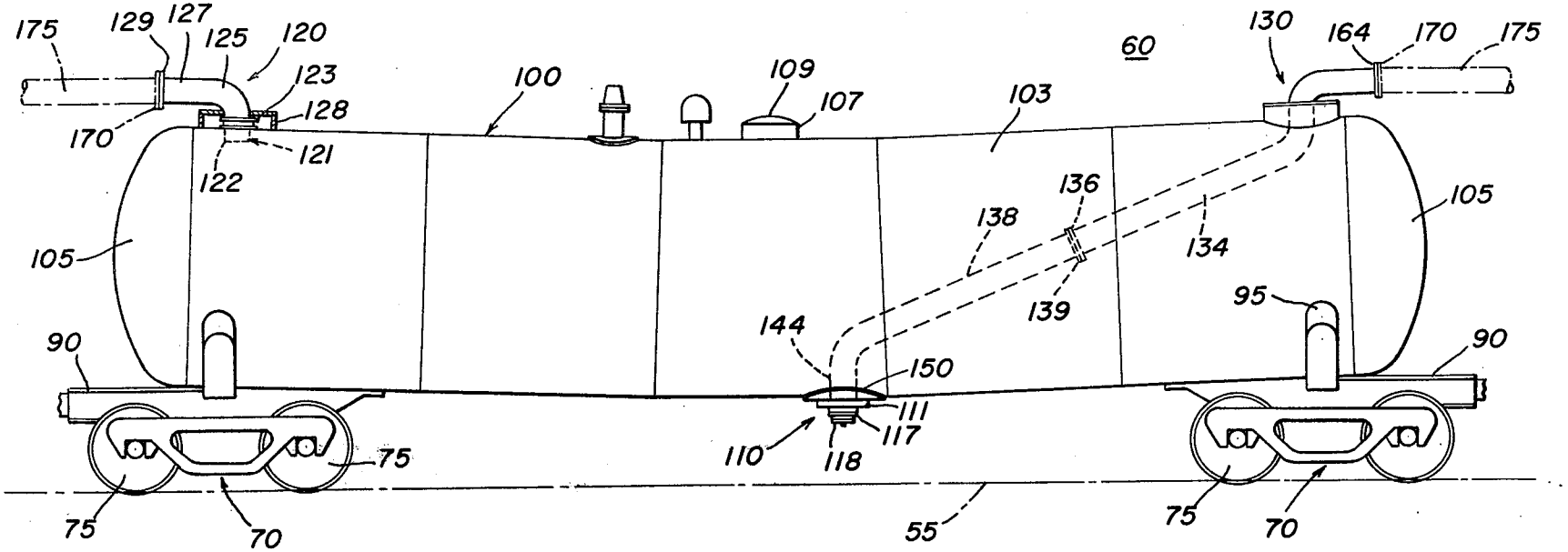
FIG. 2 is an enlarged view of a rail tank car shown in FIG. 1, particularly illustrating the shape and configuration of the eduction conduit.
Figures 3, 4:
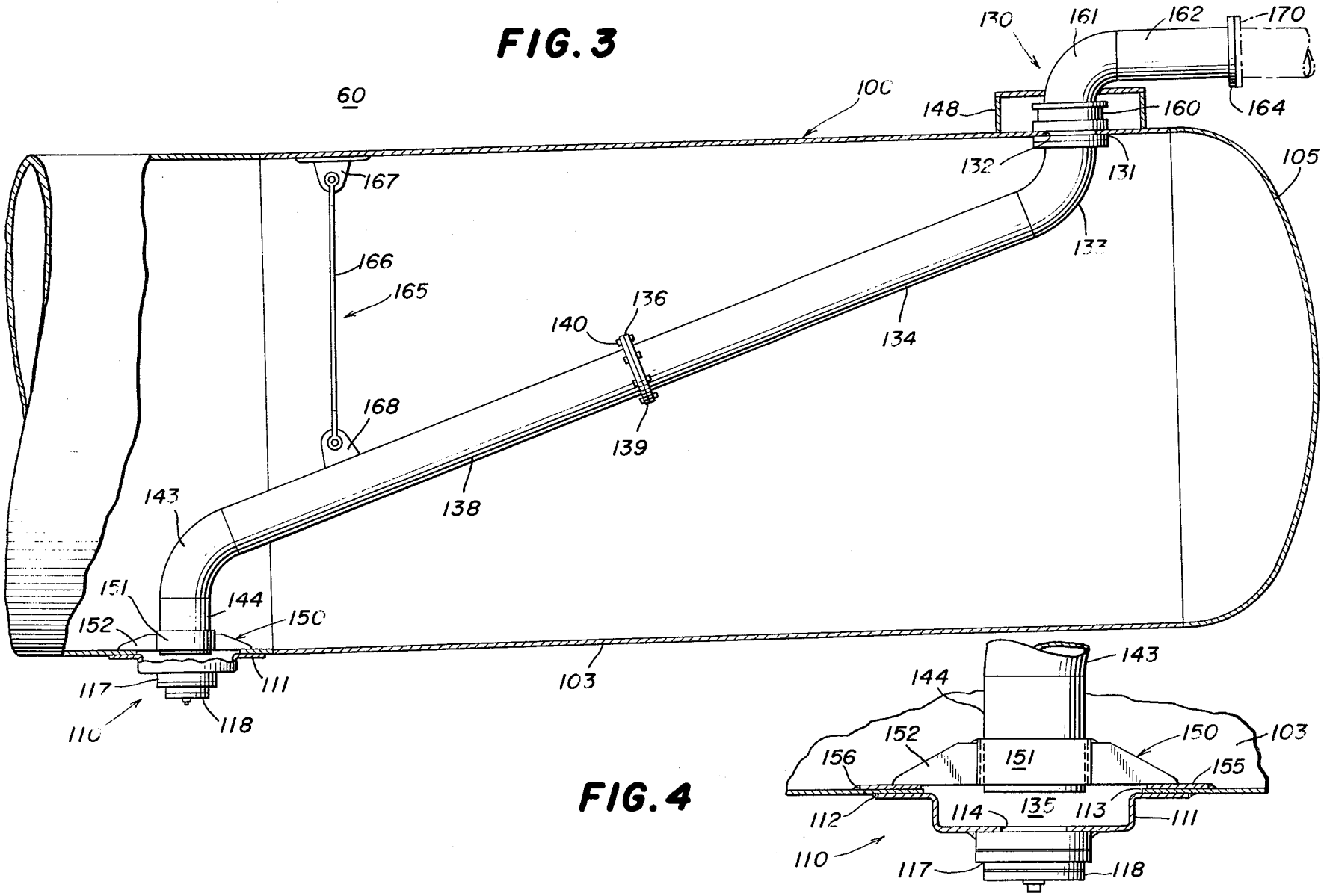
FIG. 3 is an enlarged elevational view partly in section of a portion of the tank car shown in FIG. 2.
FIG. 4 is an enlarged view of the loading and unloading assembly shown in FIG. 3.

Using conventional trucks and a standard overhang as illustrated in FIGS. 1 and 2, it will be appreciated that the necessary slack length in the flexible connecting conduit 175 might not be provided if the conduits 120 and 130 extended outwardly beyond adjacent ends of the tank 100 because the connecting conduit 175, while being flexible, is of sufficient stiffness to prevent its being bent into a tight curve, whereby the amount of slack which can be provided in the connecting conduit 175 increases with the length thereof. In this regard, the positioning of the conduits 120 and 130 at the tops of the tanks 100 permits a length of flexible connecting conduit 175 which would not be permitted if the conduits 120 and 130 were located on the heads 105 of the tank 100.

After the train 50 has reached its destination, the tanks 100 thereof may be unloaded by connecting the eduction conduit 130 at one end of the train to an associated liquid lading reservoir or other storage facility by suitable connecting means. At this point, the valves 123 and 160 of the tanks 100 would all be simultaneously automatically opened. The tank at the opposite end of the train is pressurized with an appropriate gas as through the vent conduit 120 thereof, whereby the liquid lading therein will be forced upwardly through the eduction pipe 130 and the flexible connecting conduit 175 to the next adjacent tank 100 and at the same time the liquid lading will be forced from the tank at the other end of the train into the storage facility, thus to unload serially the entire train of tank cars. This unloading will continue until the first pressurized tank 100 is empty, after which each succeeding tank 100 will in turn be emptied until the entire train has been unloaded. Thus, it will be appreciated that the entire train 50 can be unloaded in a single operation at a single location without movement of the train or disconnection of any of the cars thereof. It is apparent that the sump 135 in cooperation with the placement of the terminal portion 144 of the eduction conduit 130 facilitate the eduction emptying of the tank 100.

As described, the eduction conduit 130 is the inlet during loading and outlet during unloading while the vent 120 is the outlet during loading and the inlet during unloading.

Referring again to FIG. 1, there is illustrated an alternative method of filling and emptying the train of tank cars utilizing the loading the unloading assembly 110 at the bottom of the individual tank cars. More specifically, during the loading operation, a connection can be made through a pipe 190 from the source 40 of liquid lading to the assembly 110 of the adjacent tank car 100. The downwardly sloping bottom wall of the tank 100 cooperates with the sump 135 and the apparatus 110 to insure complete draining of the liquid lading without the need for additional external piping. Likewise, when unloading the train 50, the source of gas under pressure can be applied through the conduit 120 of the assembly 110 and the line 190 connected to a suitable receptacle for the lading, thus to unload the train serially.

In yet another method of unloading the train 50 of tank cars 100, one of the tank cars 100, and preferably a tank car at one of the ends of the train 50 is filled with an inert gas such as nitrogen which is pressurized to a high pressure such as 250 p.s.i. When the train reaches the point for unloading, the inert gas is connected to the vent connection 120 of the adjacent railway car carrying lading and the inert gas pressure utilized to force the lading out of the tank cars in the manner described hereinabove.

It is seen, therefore, that there has been provided a train 50 of interconnected railway cars 60, each car having a vent conduit 120 and an eduction conduit 130. The eduction conduit 130 of the present invention offers considerable advantages not heretofore possible. Because the eduction conduit 130 is comprised of two pipe sections 134 and 138, it is possible to assemble the eduction conduit 130 in presently existing railway cars with very minor modifications, resulting in a substantial savings in both manpower and new equipment construction. Both sections 134 and 138 of the eduction conduit 130 may be assembled inside the associated tank 100 by lowering the sections individually into the tank 100 through the manway 107. Once inside the tank 100, it is a simple matter to assemble the eduction conduit 130 by joining the two sections 134 and 138 at the sealed flanges 136 and 139, respectively. The support 165 maintains the section 138 from above while the spyder 150 serves to position the terminal portion 144 over the sump 135 in registry with the outlet pipe 117. This ease of construction just described, facilitates the use of the present invention with presently existing tank cars. The fact that the conduits 127 and 162 of the vent conduit 120 and eduction conduit 130, respectively, terminate inboard of the associated end 105 of the tank 100 permits the flexible conduit 175 to be of sufficient length to accommodate the usual movements of sway and turn encountered during normal railway movement.

While there has been described herein what is at present considered to be the preferred embodiment of the present invention, it will be understood that various modifications and alterations may be made herein without departing from the true spirit and scope of the present invention, and it is intended to cover in the appended claims all such modifications and alterations as fall within the true spirit and scope of the present invention.

What is claimed is:

1. A railway tank car for interconnection in fluid communication with associated like tank cars by flexible connecting conduits for accommodating consecutive loading, transporting and unloading of expandable liquid ladings, said tank car comprising a wheeled chassis structure provided with chassis coupling means for coupling to the chassis of associated like cars, a tank mounted on said chassis structure, said tank having the bottom thereof sloping downwardly from both ends, a lading vent conduit and a lading eduction conduit respectively coupled to said tank adjacent to the opposite ends thereof and being in fluid communication therewith, each of said lading conduits extending through the top of said tank and having an outer end extending outwardly from said tank adjacent to the top thereof and terminating inboard of the associated tank car end, the inner end of said vent conduit terminating a predetermined distance below the top of said tank, filling of said tank to a level above the inner end of said vent conduit causing compression of gas trapped above said liquid lading to a pressure at which occurs outflow of liquid lading through said vent conduit at the same rate as the inflow of liquid lading through said eduction conduit thereby to provide in said tank above the liquid lading a free vapor space, said eduction conduit extending diagonally downwardly in said tank and terminating closely adjacent to the bottom of said tank to facilitate emptying of said tank through said eduction conduit, a loading and unloading assembly mounted on the bottom of said tank at the center thereof for connection to a source of lading for loading said tank and for connection to an outlet pipe for unloading said tank, the sloping bottom facilitating complete draining without external piping, and conduit coupling means on each of said lading conduits for coupling to an adjacent end of an associated flexible connecting conduit to place said tank in fluid communication with the tanks of adjacent-like tank cars, whereby said tank may be connected by associated flexible connecting conduits to associated-like tanks in a series through which expandable liquid lading may flow to accommodate consecutive loading to a predetermined level, transporting thereof while automatically providing a free vapor space at the top of said tank above the liquid lading, and substantially complete unloading thereof through said eduction conduit.

2. The railway tank car set forth in claim 1, and further including a sump in the bottom of said tank in registry with the lower terminal end of said eduction conduit.

3. The railway tank car set forth in claim 1, and further including a sump in the bottom of said tank in registry with the lower terminal end of said eduction conduit, the bottom of said sump being below the bottom of said tank.

4. The railway tank car set forth in claim 1, wherein the lower terminal portion of said eduction conduit in said tank is substantially normal to the longitudinal axis of said tank.

5. The railway tank car set forth in claim 1, wherein the bottom of said tank slopes downwardly from each end and toward the center, and further comprising a loading and unloading assembly mounted in the bottom of said tank at the center thereof and forming a sump therewith, the lower portion of said eduction conduit overlying said loading and unloading assembly and being substantially normal to the longitudinal axis of said tank, the sloping bottom of said tank cooperating with said sump and said loading and unloading apparatus to facilitate complete draining of the lading without external piping.

6. The railway tank car set forth in claim 1, and further including support means mounted in said tank and connected to said eduction conduit for supporting same.

7. The railway tank car set forth in claim 1, and further including a first support connected to the bottom of said tank for retaining the lower terminal portion of said eduction conduit in fixed spaced relation to said tank and a second support connected to the top of said tank and to said eduction conduit for supporting said conduit from above.

8. The railway tank car set forth in claim 1, wherein said eduction conduit is comprised of two sections each about one-half the total length of said conduit, said two sections being disposed in sealing relationship to one another.

9. A railway tank car for interconnection in fluid communication with associated like tank cars by flexible connecting conduits for accommodating consecutive unloading of fluid ladings, said tank car comprising a wheeled chassis structure provided with chassis coupling means for coupling to the chassis of associated like cars, a tank mounted on said chassis structure, said tank having the bottom thereof sloping downwardly from both ends, a lading input conduit and a lading output conduit respectively coupled to said tank adjacent to the opposite ends thereof and being in fluid communication therewith, each of said lading conduits extending through the top of said tank and having an outer end extending outwardly from said tank adjacent to the top thereof terminating inboard of the associated tank car end and an inner end extending into said tank, said output conduit extending diagonally downwardly in said tank and terminating closely adjacent to the bottom of said tank to facilitate emptying of said tank through said output conduit, a loading and unloading assembly mounted on the bottom of said tank at the center thereof for connection to a source of lading for loading said tank and for connection to an outlet pipe for unloading said tank, the sloping bottom facilitating complete draining without external piping, and conduit coupling means on each of said lading conduits for coupling to an adjacent end of an associated flexible connecting conduit to place said tank in fluid communication with the tanks of adjacent like tank cars, whereby said tank may be connected by associated flexible connecting conduits to associated like tanks in a series through which fluid lading may flow to accommodate consecutive unloading thereof while the position of said lading conduits adjacent to the top of said tank safely accommodates the relative motions of the tank cars in transit.

10. A railway tank car train for accommodating consecutive loading, transporting and unloading of expandable liquid ladings, said train comprising a plurality of railway tank cars connecting in tandem relationship, each of said tank cars comprising a wheeled chassis structure provided with chassis coupling means for coupling said cars together, a tank mounted on said chassis structure, said tank having the bottom thereof sloping downwardly from both ends, a lading vent conduit and a lading eduction conduit respectively coupled to each of said tanks adjacent to the opposite ends thereof and being in fluid communication therewith, each of said lading conduits extending through the top of said tank and having an outer end extending outwardly from said tank adjacent to the top thereof and terminating inboard of the associated tank car end, the inner end of said vent conduit terminating a predetermined distance below the top of said tank, filling of said tank to a level above the inner end of said vent conduit causing compression of gas trapped above said liquid lading to a pressure at which occurs outflow or liquid lading through said vent conduit at substantially the same rate as the inflow of liquid lading through said eduction conduit thereby to provide in said tank above the liquid lading a free vapor space, said eduction conduit extending diagonally downwardly in said tank and terminating closely adjacent to the bottom of said tank to facilitate emptying of said tank through said eduction conduit, a loading and unloading assembly mounted on the bottom of said tank at the center thereof for connection to a source of lading for loading said tank and for connection to an outlet pipe for unloading said tank, the sloping bottom facilitating complete draining without external piping, and conduit coupling means at the outer end of each of said lading conduits, a plurality of flexible connecting conduits respectively extending between adjacent coupled ones of said tank cars and coupled to said conduit coupling means thereon at the tops of said tanks, said flexible connecting conduits interconnecting said lading conduits to place the adjacent ones of said tanks in fluid communication with each other while safely accommodating the relative motions between the tank cars in transit, whereby said flexible connecting conduits cooperate with said tanks to form a continuous lading vessel through which expandable liquid lading may flow to accommodate consecutive loading to a predetermined level, transporting thereof while automatically providing a free vapor space at the top of each tank above the expandable liquid lading, and substantially complete unloading thereof through said eduction conduits, the position of said lading conduits adjacent to the tops of said tanks permitting said flexible connecting conduits safely to accommodate the relative motions between adjacent ones of said tank cars in transit.

11. A railway tank car for interconnection in fluid communication with associated like tank cars by flexible connecting conduits for accommodating consecutive loading, transporting and unloading of expandable liquid ladings, said tank car comprising a wheeled chassis structure provided with chassis coupling means for coupling to the chassis of associated like cars, a tank mounted on said chassis structure, said tank having the bottom thereof sloping downwardly from both ends, a lading vent conduit and a lading eduction conduit respectively coupled to said tank adjacent to the opposite ends thereof and being in fluid communication therewith, two valves mounted on said tank externally thereof and respectively connected in said lading vent conduit and said lading eduction conduit for controlling the flow of liquid lading through said vent and eduction conduits, each of said lading conduits extending through the top of said tank and having an outer end extending outwardly from said tank adjacent to the top thereof and terminating inboard of the associated tank car end, the inner end of said vent conduit terminating a predetermined distance below the top of said tank, filling of said tank to a level above the inner end of said vent conduit causing compression of gas trapped above said liquid lading to a pressure at which occurs outflow of liquid lading through said vent conduit at the same rate as the inflow of liquid lading through said eduction conduit thereby to provide in said tank above the liquid lading a free vapor space, said eduction conduit extending diagonally downwardly in said tank and terminating closely adjacent to the bottom of said tank to facilitate emptying of said tank through said eduction conduit, a loading and unloading assembly mounted on the bottom of said tank at the center thereof for connection to a source of lading for loading said tank and for connection to an outlet pipe for unloading said tank, the sloping bottom facilitating complete draining without external piping, and conduit coupling means on each of said valves for coupling to an adjacent end of an associated flexible connecting conduit to place said tank in fluid communication with the tanks of adjacent-like tank cars, whereby said tank may be connected by associated flexible connecting conduits to associated-like tanks in a series through which expandable liquid lading may flow to accommodate consecutive loading to a predetermined level, transporting thereof while automatically providing a free vapor space at the top of said tank above the liquid lading, and substantially complete unloading thereof through said eduction conduit.

* * * * *